US009480871B2

(12) United States Patent
Domesick

(10) Patent No.: US 9,480,871 B2
(45) Date of Patent: Nov. 1, 2016

(54) BELT-BASED SYSTEM FOR STRENGTHENING MUSCLES

(71) Applicant: Michael H. Domesick, Boston, MA (US)

(72) Inventor: Michael H. Domesick, Boston, MA (US)

( * ) Notice: Subject to any disclaimer, the term of this patent is extended or adjusted under 35 U.S.C. 154(b) by 274 days.

(21) Appl. No.: 13/835,066

(22) Filed: Mar. 15, 2013

(65) Prior Publication Data

US 2014/0274608 A1 Sep. 18, 2014

(51) Int. Cl.

| | |
|---|---|
| ***A63B 21/00*** | (2006.01) |
| ***A63B 21/012*** | (2006.01) |
| ***A63B 23/02*** | (2006.01) |

(52) U.S. Cl.

CPC ..... *A63B 21/0125* (2013.01); *A63B 21/00047* (2013.01); *A63B 21/00058* (2013.01); *A63B 21/00069* (2013.01); *A63B 21/151* (2013.01); *A63B 21/4035* (2015.10); *A63B 21/4037* (2015.10); *A63B 21/4045* (2015.10); *A63B 23/02* (2013.01); *A63B 23/0205* (2013.01)

(58) Field of Classification Search

CPC ..... A63B 21/0004; A63B 21/00043; A63B 22/02; A63B 2022/0214; A63B 2022/0221; A63B 2022/0228; A63B 21/0047; A63B 21/1473; A63B 21/1769; A63B 2022/0278; A63B 2022/0292; A63B 21/012; A63B 21/0125; A63B 21/015; A63B 21/018; A63B 21/028

See application file for complete search history.

(56) References Cited

U.S. PATENT DOCUMENTS

| | | | | |
|---|---|---|---|---|
| 4,151,988 | A | 5/1979 | Nabinger | |
| 4,204,673 | A | 5/1980 | Speer, Sr. | |
| 4,659,074 | A * | 4/1987 | Taitel | A63B 21/015 188/187 |
| 5,372,560 | A | 12/1994 | Chang | |
| 5,695,436 | A | 12/1997 | Huang | |
| 6,013,010 | A | 1/2000 | Farsaie | |
| D439,291 | S | 3/2001 | Barnett et al. | |
| 6,338,703 | B1 | 1/2002 | Yu | |
| 6,354,983 | B1 | 3/2002 | Lee | |
| 6,409,639 | B1 | 6/2002 | Kuo | |
| 6,440,045 | B1 | 8/2002 | Gaston | |
| 6,582,347 | B2 | 6/2003 | Smith | |
| 7,621,858 | B2 | 11/2009 | Sheron | |
| 7,824,319 | B2 | 11/2010 | Carlesimo et al. | |
| 7,993,250 | B2 | 8/2011 | Abbott | |
| 8,118,718 | B2 | 2/2012 | Brodess et al. | |
| 8,241,186 | B2 | 8/2012 | Brodess et al. | |
| 8,353,808 | B1 | 1/2013 | Barney | |
| 8,465,402 | B2 | 6/2013 | Ehmann et al. | |
| 8,500,611 | B2 | 8/2013 | Hoffman | |
| 8,550,965 | B2 | 10/2013 | Candela et al. | |

(Continued)

FOREIGN PATENT DOCUMENTS

WO 9920352 A1 4/1999

*Primary Examiner* — Oren Ginsberg
*Assistant Examiner* — Megan Anderson

(57) ABSTRACT

Systems and methods are presented for performing exercises to strengthen the transversus abdominis and related muscles. The systems and methods may involve one or more independent belts, allowing a full range of continuous motion. The systems and methods may further use a resistance-control mechanism that allows a user to adjust the force required to move the one or more belts, thereby controlling the rate of motion in the forward and/or backward directions. The systems and methods may further use a unidirectional resistance mechanism that allows the user to increase the resistance of the one or more belts in one direction, while allowing the one or more belts to move freely in the other direction.

26 Claims, 15 Drawing Sheets

(56) References Cited

U.S. PATENT DOCUMENTS

| | | | | |
|---|---|---|---|---|
| 8,608,624 | B2 | 12/2013 | Shabodyash et al. | |
| 8,740,756 | B2 | 6/2014 | Shabodyash et al. | |
| 8,986,176 | B2 * | 3/2015 | Arst | A63B 21/015 482/119 |
| 2005/0209072 | A1 | 9/2005 | Sheron | |
| 2006/0189438 | A1 | 8/2006 | Black | |
| 2009/0124471 | A1 * | 5/2009 | Storch | 482/141 |
| 2010/0004105 | A1 | 1/2010 | Peddar | |
| 2011/0039666 | A1 | 2/2011 | Ehmann et al. | |
| 2011/0294631 | A1 | 12/2011 | Wu | |
| 2012/0040802 | A1 * | 2/2012 | Dibble et al. | 482/54 |
| 2012/0043184 | A1 | 2/2012 | Marshall et al. | |
| 2014/0274578 | A1 * | 9/2014 | Kennedy | A63B 21/015 482/54 |
| 2015/0209611 | A1 * | 7/2015 | Arst | A63B 22/02 482/54 |

* cited by examiner

BELT-BASED SYSTEM FOR STRENGTHENING MUSCLES

BACKGROUND

1. Field of the Invention

The present invention relates generally to exercise systems and, more specifically, to systems for strengthening, the abdominal muscles and related muscle groups.

2. Discussion of Related Art

Exercises designed to strengthen muscles such as the transversus abdominis muscle and related muscle groups have long played an important role in workout routines intended to improve fitness and health. The abdominal muscles come into play in almost every functional movement that involves the body's "core" components. Also, exercising these muscles can flatten the stomach and minimize the paunchy appearance of abdominal muscular sag or fat deposits, even in otherwise slender, fit individuals.

According to some researchers and fitness experts, three of the best exercises for engaging the transversus abdominis and toning the core include: ab rollouts, reverse ab rollouts, and ab planks. The first of these exercises, the "ab rollout", has been the basis of several fitness products in the past: the "Ab Wheel," the "Ab Slide," and the "Torso Track."

The "Ab Wheel," as shown in FIG. 14, consists of a wheel with two side handles. To use an Ab Wheel, one assumes a kneeling or standing position, grasps the handles, and rolls forward across the floor, then back. The basic principle is this: because gravity tends quickly to propel us forward, one is forced to engage one's transversus abdominis to slow the forward rate of motion and maintain balance. However, using an Ab Wheel properly requires a relatively high degree of initial abdominal conditioning. Without the proper experience and conditioning, exercising with the Ab Wheel can cause hyperextension.

The Ab Slide and the Torso Track were designed to slow the rate of forward motion, thereby making the exercise easier and less dangerous to perform. However, neither of these products is fully adjustable, allowing the user to freely vary the level of forward resistance. The Ab Slide, implemented using a torsion spring, was designed with a one-size fits all approach and is not at all adjustable. The Torso Track, implemented using rubber bands, had only two or three difficulty settings, and switching among them required the user to manually adjust rubber bands.

In addition, both the Ab Slide and the Torso Track allowed only a limited range of motion, and could be used to perform a limited number of exercises. The Ab Slide could only slide a short distance before the torsion spring wound up completely, preventing further movement. The Torso Track could only move as far as its rubber bands could stretch. Also, both the Ab Slide and the Torso Track were designed primarily for an ab rollout-type motion, ignoring reverse ab rollouts and planks, two of the three most important abdominal exercises referred to above.

SUMMARY OF THE INVENTION

Herein are described systems for performing a variety of abdominal exercises, the systems including a rigid framework, a first belt configured to roll relative to the framework in both clockwise and counter-clockwise directions, a second belt configured to roll relative to the framework in both clockwise and counter-clockwise directions, and a resistance-control mechanism for controlling the amount of force required to roll the first and second belts in one or more of the clockwise and counter-clockwise directions.

Herein are further described systems including a rigid framework, a single belt configured to roll relative to the framework in both clockwise and counter-clockwise directions, and a resistance-control mechanism for controlling the amount of force required to roll the belt in one or more of the clockwise and counter-clockwise directions.

Embodiments of the present invention may employ one-way resistance-control mechanisms that control the resistance in only the clockwise or the counter-clockwise direction, but not both. Embodiments of the present invention may include belts that run along substantially parallel paths. Embodiments may include detachable or integrated risers that are used to create an incline. Embodiments may include belts that are constructed of modular segments linked by hinged interconnects, or a one-piece fixed-length belt which approximates the look and feel of a modular belt.

BRIEF DESCRIPTION OF THE DRAWINGS

For a more complete understanding of various embodiments of the present invention, reference is now made to the following descriptions taken in connection with the accompanying drawings in which.

DETAILED DESCRIPTION

Figure 1:
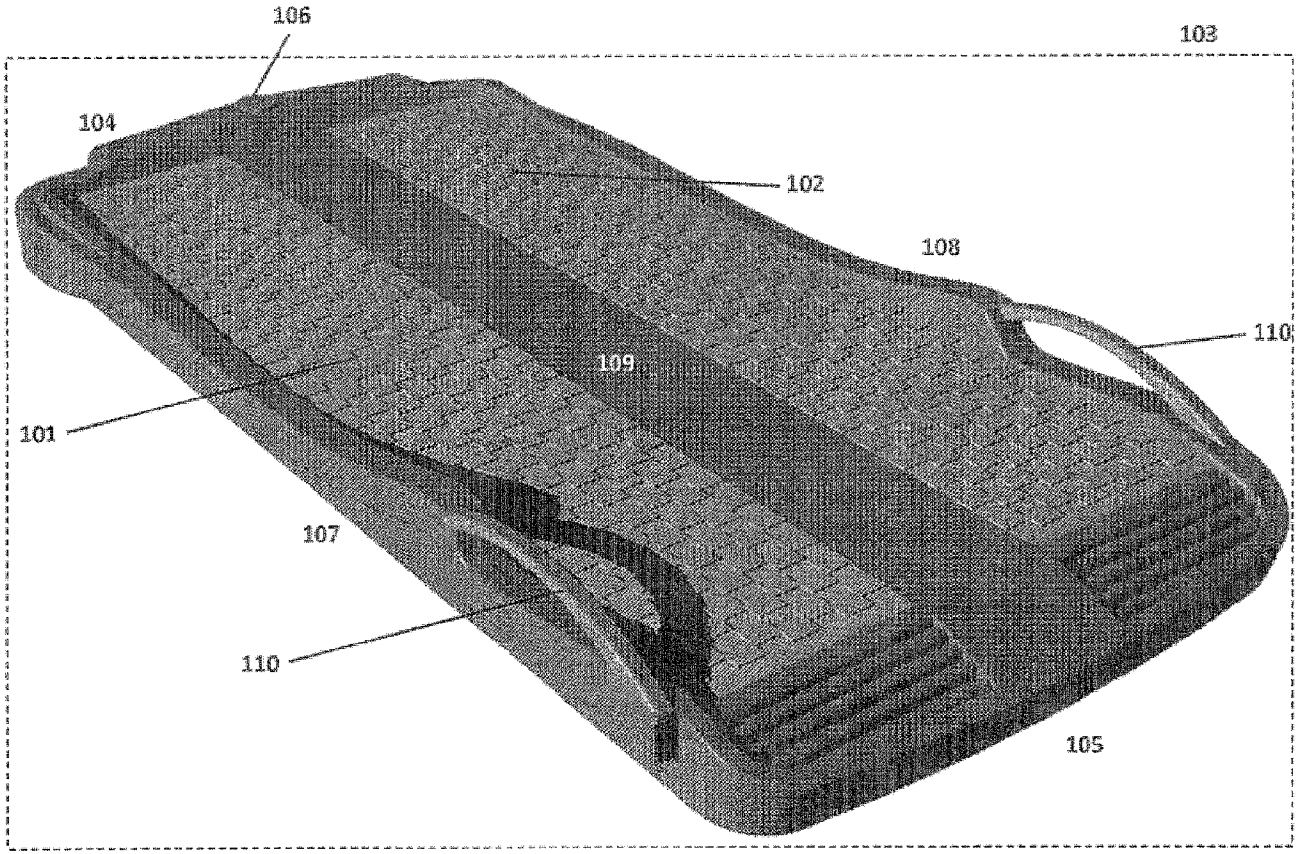
FIG. 1 shows a system with two continuous belts, left and right handles, resistance control knob, and side/center trim, according to some embodiments.

FIG. 1 illustrates one embodiment of the present invention. Continuous belts 101, 102 are looped around axles that allow them to roll in a direction parallel to the long axis of framework 103. In some embodiments, belts 101, 102 may roll bi-directionally, in both "forward" and "backward" directions, depending on the direction of the force that is applied to the top surface of the belt. Applying a force pointing toward front end 104 causes a belt to roll in the "forward" direction, such that points on the top surface of the belt move toward the front end 104 of the framework; applying a force pointing toward back end 105 causes the belt to roll in the "backward" direction, such that points on the top surface of the belt move toward the back end 105 of the framework.

Figure 2:
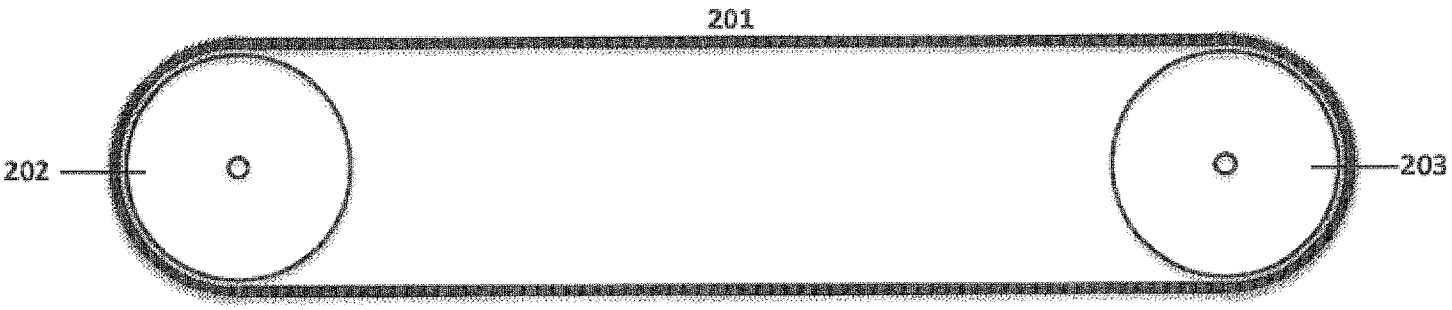
FIG. 2 is a schematic showing a cross-section of a belt looped around front and back axles, forming a continuous loop, according to some embodiments.

In some embodiments, each belt forms a continuous loop around front and back axles, located respectively at the front 104 and back 105 ends of framework 103. FIG. 2 shows a horizontal cross section of this loop for a single belt. Belt 201 is looped around front axle 202 and back axle 203, so it may roll continuously in both the forward (counterclockwise) and backward (clockwise) directions. Sprockets (not shown) may be placed around the axles to prevent the belt from slipping relative to the front and back axles. Further, referring again to FIG. 1, the axles around which belt 101 is looped may be decoupled from the axles around which belt 102 is looped. Thus, in some embodiments, the two belts may roll independently of each other; at any particular time, the two belts may be rolling at different rates, or in different directions.

In some embodiments, the force required to roll belts 101, 102 relative to framework 103 may be controlled by resistance control knob 106. For example, turning resistance control knob 106 in a clockwise direction may increase the force required to roll the belts, while turning the knob in a counterclockwise direction may decrease the force required to roll the belts. In some embodiments, resistance control knob 106 controls the force required to roll the belts in the forward direction only, while the belts may be rolled in the backward direction by applying a minimal amount of force. This may be accomplished using mechanisms such as one-way bearings, as described in more detail below.

In the embodiment shown in FIG. 1, the majority of belts 101, 102 are hidden from view at any given time; only the top surfaces of the belts are visible. At both the front 104 and back 105 ends, framework 103 includes "trim" that conceals the axles around which the belts are looped, so the visible portions of the belts form substantially planar surfaces. Trim is also included on the left 107 and right 108 sides of the framework, concealing the outer rims of belts 101, 102, and along a strip 109 in the middle of the framework, concealing the inner rims of the belts. The trim on the four sides and along the center of the framework prevents damage to the machine and minimizes the risk of injury to the user by shielding and protecting the axles, the resistance control mechanism, and other moving parts. Handles 110 are fixed to the left 107 and right 108 sides of the framework.

Embodiments like the system pictured in FIG. 1 may be designed to allow multiple such systems to be stacked vertically for storage. In such embodiments, each machine in a stack may interlock with the machines immediately above and beneath it, preventing it from moving horizontally relative to its neighbors. Embodiments may be designed to allow vertical stacks in which every machine in the stack has the same orientation (i.e., every machine in the stack is face-up, with the front and back ends pointing in the same direction), or stacks in which adjacent machines are oriented differently (e.g., stacks in which every other machine is rotated 180° around a vertical axis so the bottom surface of the front end of one machine is stacked atop the top surface of the back end of another; stacks in which every other machine is flipped upside-down so the top surface faces downward and touches the top surface of the machine immediately beneath it, and the bottom surface faces upward and touches the bottom surface of the machine immediately above it). To allow for the most efficient use of space, stackable embodiments may be designed to minimize the vertical distance between adjacent machines in a stack, thereby minimizing the height of the stack as a whole.

Figure 3:
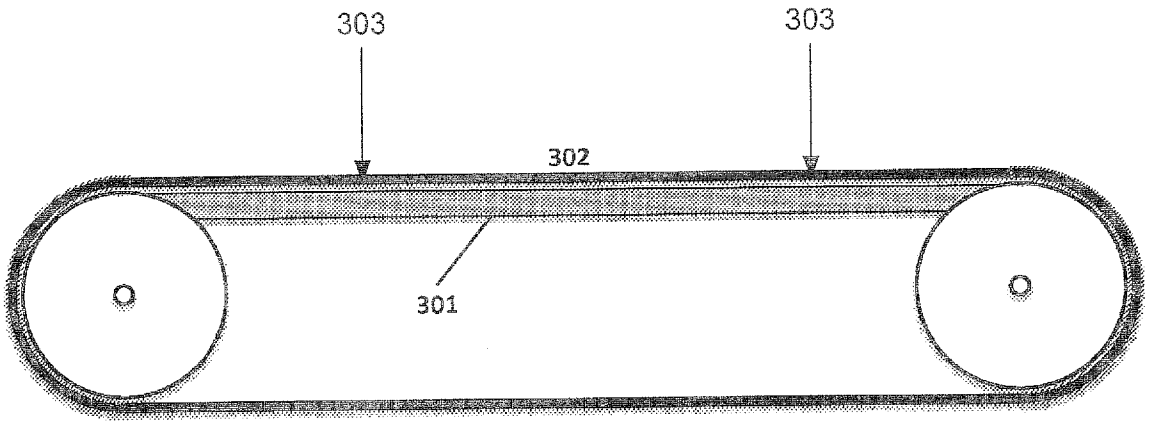
FIG. 3 is a schematic showing a cross-section of a belt looped around front and back axles supported by a slider deck, according to some embodiments.

Framework 103 may be constructed from a variety of materials, including wood, plastic, rubber, and metal (or some combination of the four). As shown in FIG. 3, in some embodiments, a "slider deck" 301 may be located immediately beneath the top portion of a belt 302. The slider deck prevents a belt from buckling or deforming when downward pressure 303 is applied to the top surface of the belt. When a belt is rolled forward or backward, it slides along the slider deck. Friction between the moving belt and the slider deck may be minimized by applying a lubricant (e.g., silicon or generic Teflon) to the top surface of the slider deck and/or to the inner surface of the belt. In addition, the inner surface of the belt and/or the upper surface of the slider deck may be constructed using materials designed to minimize friction (e.g., plastic, silicon, or generic Teflon slider strips).

The embodiment shown in FIG. 1 may be used to perform a variety of exercises, such as the "ab rollout" and the "reverse ab rollout." An "ab rollout" is a three-step exercise: (1) a user begins in a push-up position; (2) the user moves his/her hands forward to reach position; and (3) the user moves his/her hands backward, returning to the push-up position. The forward/backward movement of the hands may be facilitated by belts 101, 102 (shown in FIG. 1): first, in the starting position, the user's left hand is placed atop left belt 101, and the user's right hand is placed atop right belt 102; then, the user's hands apply a forward force (toward front end 104), causing the belts to roll forward, until the second position is reached; finally, the user's hands/torso apply a backward force (toward back end 105), causing the belts to roll backward, returning to the stating position. The embodiment of FIG. 1 may also be used to perform a "single-hand ab rollout," which is similar to an "ab rollout," except that the user is supported by only one hand throughout the exercise.

The embodiment shown in FIG. 1 may also be used to perform a "reverse ab rollout." Like the "ab rollout," the "reverse ab rollout" is a three step exercise: (1) a user begins in a crouching position; (2) the user moves his/her feet backward to reach position; and (3) the user moves his/her feet forward, returning to the first position. The forward/backward movement of the user's feet may be facilitated by belts 101, 102 (shown in FIG. 1): first, in the starting position, the user's left foot is placed atop left belt 101, and the user's right foot is placed atop right belt 102; then, the user's feet apply a backward force (toward back end 105), causing the belts to roll backward, until the second position is reached; finally, the user's feet apply a forward force (toward front end 104), causing the belts to roll forward, returning to the starting position (alternatively, reverse ab rollouts may be performed facing in the other direction, in which moving the feet backward causes the belts to roll forward, and vice versa). The embodiment of FIG. 1 may also be used to perform a "single-foot reverse ab rollout," which is similar to a "reverse ab rollout," except that the user is supported by only one foot throughout the exercise.

Additional exercises may be performed with the embodiment shown in FIG. 1, including, but not limited to, push-ups, lunges, planks, and manual treadmilling. Push-ups are facilitated by handles 110, which may be used as push-up handles. Lunges are performed by (1) starting in a push-up position, with head pointing toward front end 104 and feet on belts 101, 102; and (2) sliding the feet forward, bringing the knees toward the chest, for as long as possible. Planks are performed by (1) kneeling on belts 101, 102 and grasping handles 110; and (2) lifting the knees off the belts, such that the user's weight is supported entirely by the hands and toes, while keeping the hips in-line with the body. Manual treadmilling is performed by (1) placing the hands on belts 101, 102 in a push-up position; and (2) "walking" either forward or backward, using the left and right hands alternately to roll the left and right belts (manual treadmilling may be performed with the user's head facing front end 104, or back end 105). The descriptions above do not constitute an exhaustive list of the exercises that may be performed with embodiments of the present invention, but serve as illustrative examples only.

As described above, resistance control knob 106 may be used to control the amount of force required to roll belts 101, 102. In some embodiments, this is accomplished using a mechanism like the one illustrated in FIG. 4, which is a schematic diagram showing a horizontal cross-section of the resistance-control mechanism. Resistance control knob 601 is connected to screw 602, which passes through axle housing 603, and presses against the top half of annular friction element 604. Annular friction element (including top half 604 and bottom half 605) is constructed using an elastic material with a high kinetic friction coefficient, such as rubber; thus, when screw 602 is moved downward, resistance axle 606 is compressed between the upper 604 and lower 605 halves of the annular friction element, increasing the inward normal force on the outer surface of resistance axle 606, which increases the amount of torque that is required to rotate resistance axle 606. In some embodiments, resistance axle 606 runs parallel to the front axle of a belt, and is connected to the front axle (e.g., front axle 202 of belt 201, as shown in FIG. 2), so the force required to move the belt in the forward and/or backward direction is proportional to the torque required to rotate resistance axle 606. Thus, turning resistance control knob 601 clockwise increases the belt's resistance, and turning resistance control knob 601 counter-clockwise decreases the belt's resistance.

Two independent belts may be adjusted using the same friction tensioner: for example, the front axle of one belt may be connected to a resistance axle that is inserted into one end of annular friction element 604, 605, and the front axle of the other belt may be connected to a resistance axle that is inserted into the other end of annular friction element 604, 605. In this case, both resistance axles may rotate independently, but a single resistance control knob 601 may be used to adjust the torque required to turn both resistance axles. Alternatively, other embodiments may employ separate resistance-control mechanisms for each belt.

Various alternative techniques may be used to adjust the force required to roll a belt in one or both directions (e.g., torsion springs, magnetic or hydraulic tensioners, rubber bands, etc.). The resistance-control mechanism described above with reference to FIG. 4 is provided as an illustrative example only.

In some embodiments, the user may adjust the force required to move the belt in the forward direction without changing the force required to move the belt in the backward direction. As explained above, resistance in the forward direction is desirable for "ab rollouts" and similar exercises to counterbalance the tendency of gravity to push the body forward, but movement in the backward direction goes against the force of gravity, so additional resistance is unnecessary. Such embodiments may use a variety of mechanisms to accomplish this unidirectional resistance-control, such as the one-way bearing mechanisms described below.

Figure 5:
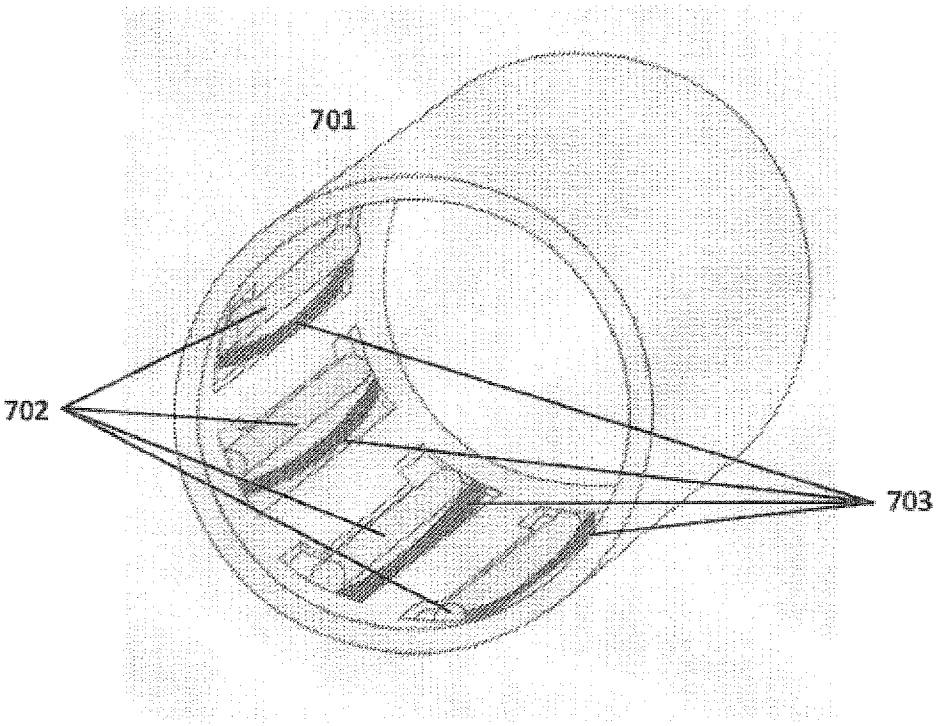
FIG. 5 shows a one-way bearing enclosure with cavities that house rollers and springs, according to some embodiments.

One-way bearings are used in a variety of mechanical devices in order to allow an object to be rotated in one direction, but not the other. As shown in FIG. 5, bearing enclosure 701 is lined with grooved cavities, each of which contains a roller 702 and a spring 703. An inner axle (not shown in FIG. 5) runs through the middle of bearing enclosure 701. As explained below, the configuration of rollers and springs allows bearing enclosure 701 to rotate independently of the inner axle only in the clockwise direction. To rotate bearing enclosure 701 in the counter-clockwise direction, the inner axle must rotate with it.

Figure 6B:
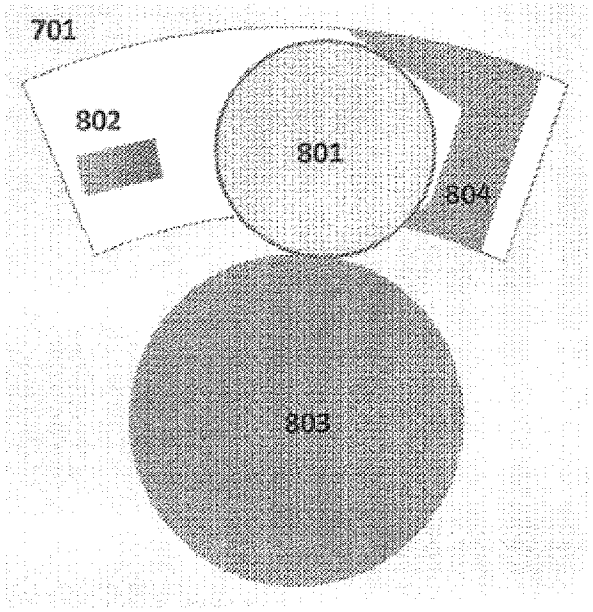
FIG. 6B shows a one-way bearing mechanism in a "locked" position, in which the bearing enclosure may not rotate independently of the inner axle, according to some embodiments.
Figure 6A:
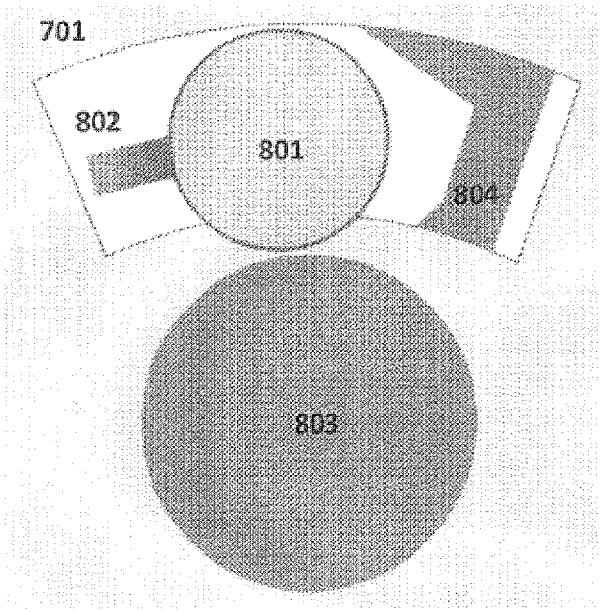
FIG. 6A shows a one-way bearing mechanism in a "free" position, in which the bearing enclosure may rotate independently of the inner axle, according to some embodiments.

FIGS. 6A and 6B show a portion of the one-way bearing mechanism in greater detail. These figures show a cross-section of a single grooved cavity in bearing enclosure 701. Roller 801 occupies the right side of the cavity, and spring 802 occupies the left side. In FIG. 6A, the mechanism is in the "free" position: because the roller 801 is not touching inner axle 803, the bearing enclosure is free to rotate independently of the inner axle. As long as the bearing enclosure rotates in the clockwise direction, roller 801 will remain in the "free" position.

However, if bearing enclosure 701 rotates in the counter-clockwise direction, roller 801 will move to the right until it is touching bearing cage 804, as shown in FIG. 6B (in which the mechanism is in the "locked" position). In this position, roller 801 is pushed inward by bearing cage 804 until it is tangent to inner axle 803, which prevents the roller from rotating. Because the roller is not free to rotate, bearing enclosure 701 is also not free to rotate and becomes locked; rotating the bearing enclosure further in the counter-clockwise direction is only possible if inner axle 803 rotates with it.

Figure 4:
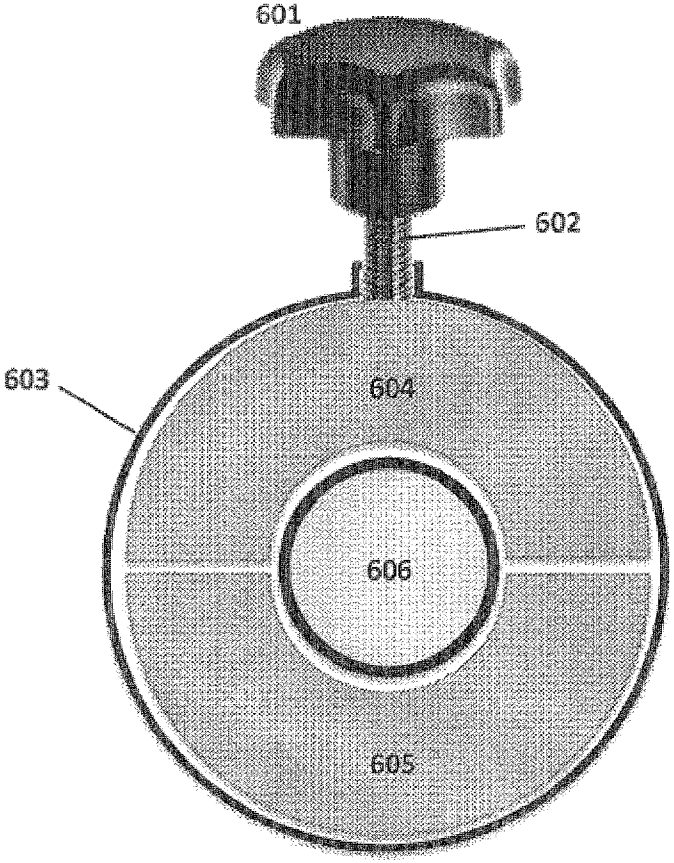
FIG. 4 is a schematic showing a cross-section of the resistance-adjustment mechanism, according to some embodiments.

Bearing enclosure 701, shown in FIGS. 5, 6A, and 6B, may be coupled to the front axle of a belt (e.g. front axle 202 of belt 201, shown in FIG. 2), and inner axle 803, shown in FIGS. 6A and 6B, may be coupled to a friction element (e.g., annular friction element 604, 605, shown in FIG. 4). In this configuration, the belt may roll in the backward direction freely, because the bearing enclosure 701 may rotate in the clockwise direction independently of inner axle 803. However, the belt encounters increased resistance when rolling in the forward direction, because rotating the bearing enclosure in the counter-clockwise direction requires rotating inner axle 803 as well. Embodiments of the present invention may use this mechanism to increase the force required to roll a belt in one direction (e.g., forward), while allowing it to roll freely in the other (e.g., backward). This result may also be achieved with a variety of alternative techniques (e.g., ratchet-based assemblies, etc.); the one-way bearing mechanism described above with reference to FIGS. 5, 6A, and 6B is provided as an illustrative example only.

Figure 7:
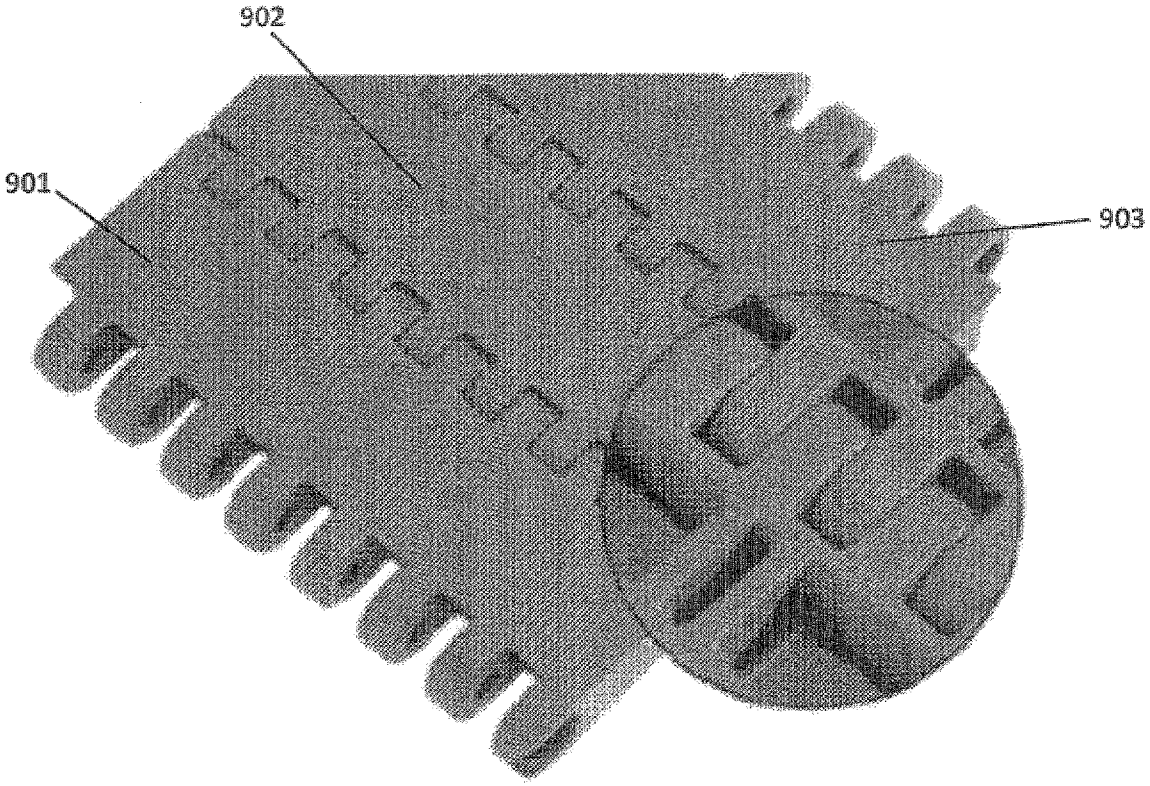
FIG. 7 shows a belt segment constructed using multiple modular belt elements, according to some embodiments.

Embodiments of the present invention may include one or more belts constructed using a variety of techniques and materials. In some embodiments, belts may be constructed using modular belt elements as illustrated in FIG. 7. Modular belt elements 901, 902, 903 interlock to form belt segments of arbitrary length. These belt segments may be formed into a continuous belt (like, e.g., belt 201 shown in FIG. 2) by attaching the modular belt element at one end of the belt segment to the modular belt element at the other end of the belt segment. Such belts are durable, relatively easy to repair, and modifiable. Repairing belts constructed using modular elements is easy and relatively inexpensive; when such a belt is damaged, it can often be fixed by replacing only the damaged belting elements, and rarely requires replacing the entire belt. Modular belts can also be lengthened or shortened as desired by adding or removing modular belt elements.

Figure 8:
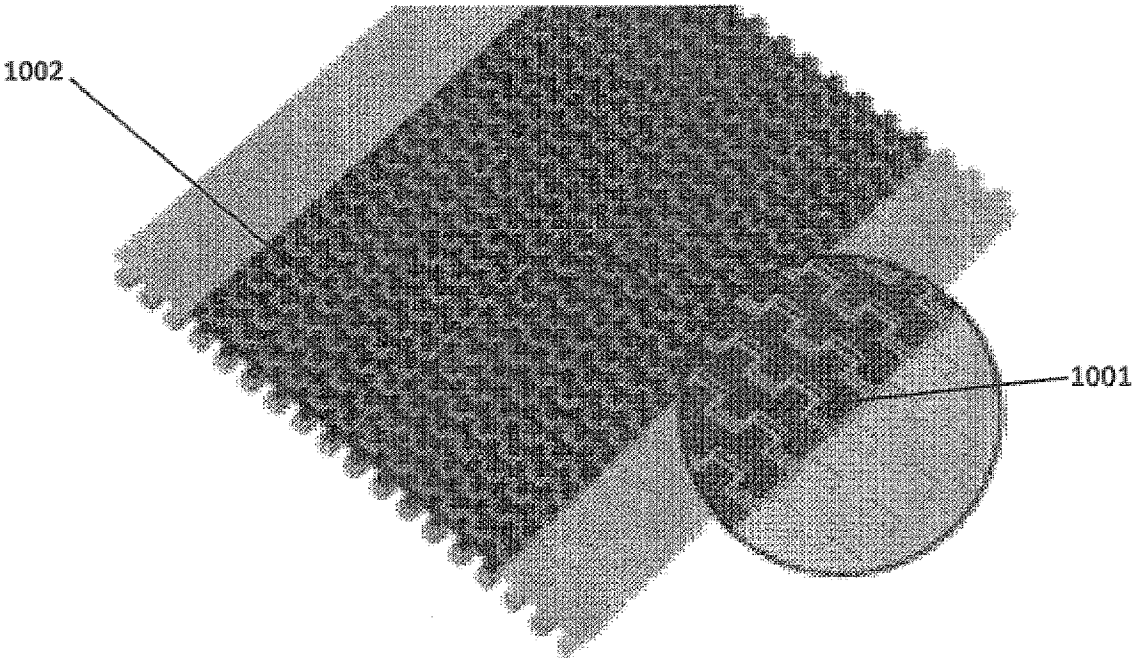
FIG. 8 shows a belt segment with an easy-to-grip strip running down its length, according to some embodiments.
Figure 9:
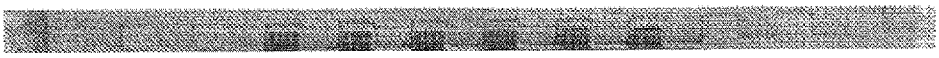
FIG. 9 shows a belt segment in which alternate belting elements are partially coated with an easy-to-grip surface, according to some embodiments.

In some embodiments, each modular belt element is totally or partially coated in a surface designed to prevent a user's hands and feet from slipping, and to provide a satisfying tactile experience. FIG. 8, shows a belt segment in which the middle upper portion of each modular belt element is coated with a rubberized, easy-to-grip surface 1001. These belting elements are assembled to form a belt with a strip of rubberized material 1002 running down its center. Other embodiments may include belts in which every other belting element is partially coated with a rubberized surface, as shown in FIG. 9. Embodiments of the present invention may use a variety of belt materials and configurations (e.g., belts made of rubber, plastic, fabric, some combination of these materials, etc.). Also, embodiments may include a one-piece fixed-length belt which approximates the look and feel of a modular belt. The descriptions of modular belts above, with reference to FIGS. 7-9, are provided as illustrative examples only.

Figure 10:
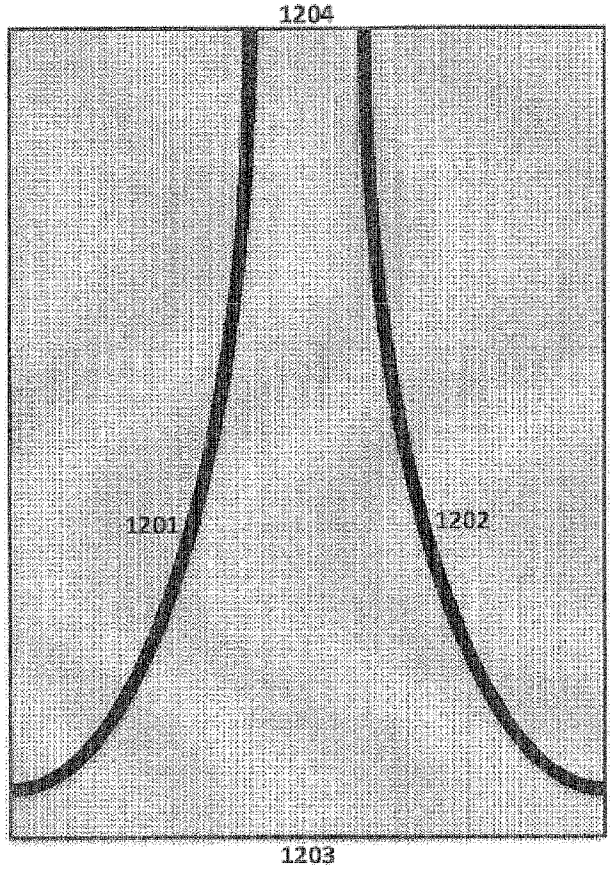
FIG. 10 shows the trajectories of two curved belts, according to some embodiments.

The embodiment illustrated in FIG. 1 has two parallel belts, but in other embodiments, one or more belts may be partially curved. For example, as illustrated in FIG. 10, a system may include two belts 1201 and 1202 that follow curved trajectories. At the back end 1203 of the device, the two belts are not parallel to each other. As the belts run along the device, they curve symmetrically away from each other, so that when they reach the front end 1204, they are parallel to each other. While the back axles of these two belts are not collinear, the front axles are, and may be adjusted using a single resistance-control mechanism as described above with reference to FIG. 4.

Figure 11:
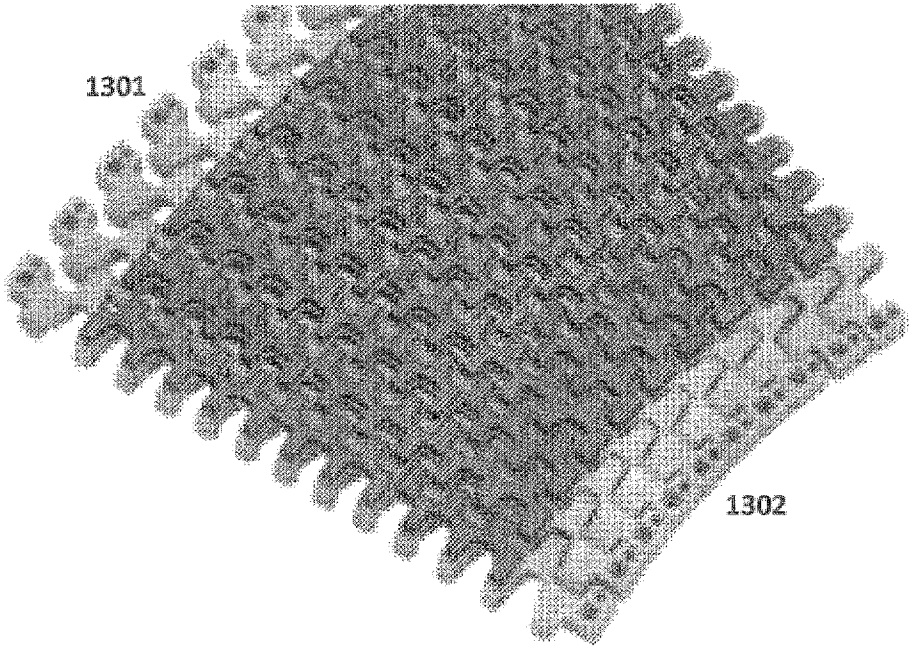
FIG. 11 shows a curved belt segment constructed from modular belt elements that are joined elastically, according to some embodiments.

To allow a belt to follow a curved trajectory, modular belt elements may be attached to each other elastically. In a curved belt segment, the outside of the curve is longer than the inside of the curve. As illustrated in FIG. 11, elastic connections allow increased separation between belting elements near the outside of the curve 1301, while maintaining close spacing between the belting elements near the inside of the curve 1302.

Some embodiments may include belts that allow users to attach hand-grips or other attachable modules to the surface of the belt. For example, a user may attach hand-grips to belts 101, 102. In such embodiments, exercises that involve placing hands on one or both belts may instead be performed by gripping one or both of the attached hand-grips. Analogous foot-grip modules may be attached to belts 101, 102 for performing exercises that involve placing feet on one or both belts. Some embodiments include belts that are designed to roll continuously even when one or more attachment modules are present; in such embodiments, the attachment module rolls with the belt along the underside of the machine until it is once again on the top surface of the belt.

In other embodiments, when an attachment module reaches the front or back end of the machine, it prevents the belt from rolling forward or backward, respectively. Such modules can be used to prevent injury, e.g., overextending the arms when performing an "ab rollout." Before beginning the ab rollout, the user positions the attachment module far enough from the front end of the machine to allow a suitable range of forward motion, but close enough to stop the forward motion of the belt before the user extends their arms too far. Such modules can also be used to limit the belt's range of backward motion. Similarly, two attachment modules may be attached to the belt—one near the front end of the machine, the other near the back end—to limit the belt's movement in both the forward and the backward directions.

Figure 12:
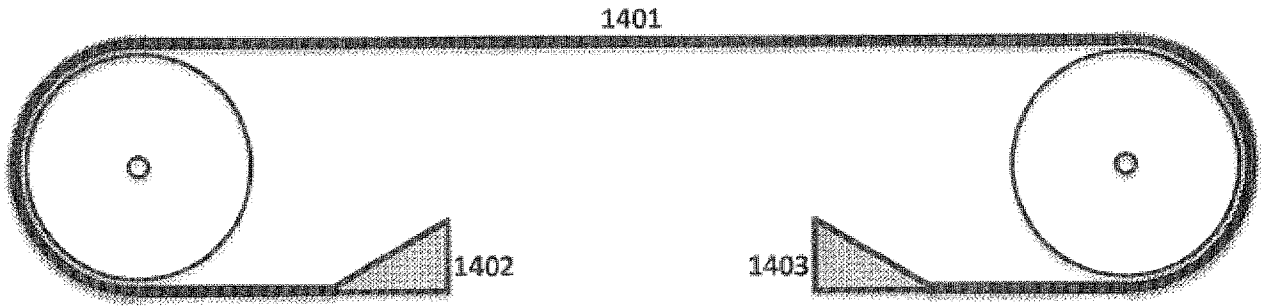
FIG. 12 shows a non-continuous belt segment with stopping elements, according to some embodiments.

In some embodiments, a belt's movement may also be limited by using a linear belt segment as illustrated in FIG. 12, instead of a belt that forms a continuous loop. In these embodiments, the belt is not designed to roll continuously in the forward or backward directions; instead, it has a finite range of motion. In some embodiments, a belt segment 1401 is terminated by stopping elements 1402 and 1403 that prevent further motion when they reach the front or back ends of the machine, respectively.

As described above, some embodiments of the present invention include two independent belts, which may follow a curved or a parallel trajectory, or a combination of the two. However, other embodiments may include only one belt. Because they include only one belt instead of two, single-belt embodiments are faster and less expensive to manufacture than dual-belt embodiments. While single-belt machines do not allow the flexibility and range of motion possible with dual-belt machines, they may still be used for a wide variety of exercises.

In some embodiments, a riser may be placed beneath one end of the machine to create an inclined plane, which may be desired to adjust the difficulty of an exercise. If a riser is placed under the front end of the machine, the belts will slope upward as they roll in the forward direction. If a riser is placed under the back end of the machine, the belts slope downward as they roll forward. In some embodiments, the underside of the machine is designed to accommodate a riser under either the front end or the back end.

Figure 13A:
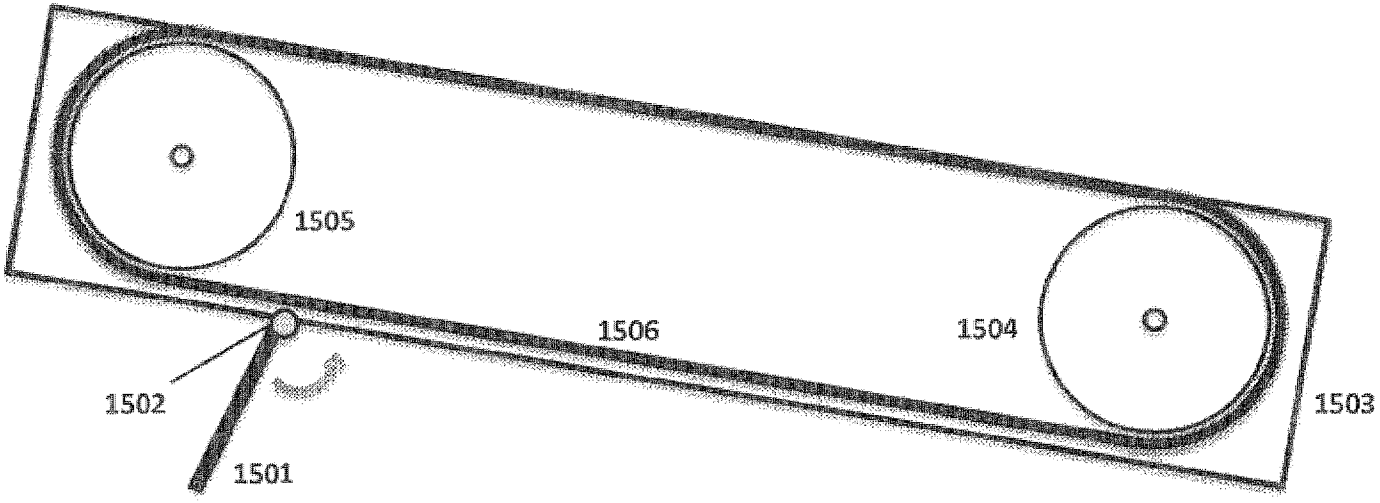
FIG. 13A shows a machine with an integrated, deployable riser under the front end of the machine, according to some embodiments.
Figure 13B:
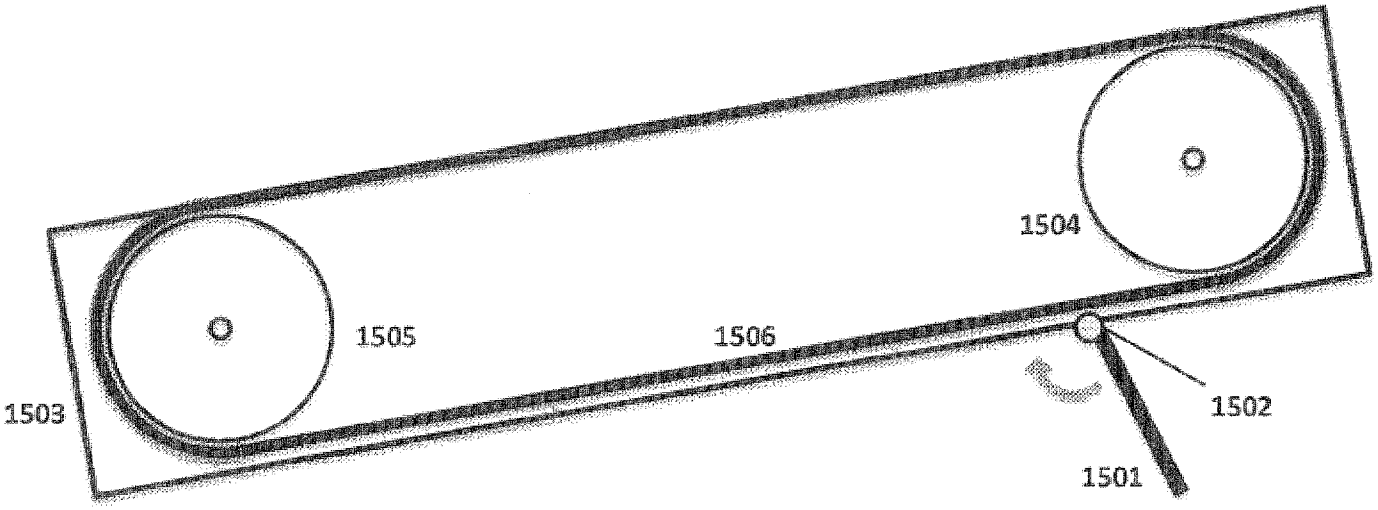
FIG. 13B shows a machine with an integrated, deployable riser under the back end of the machine, according to some embodiments.
Figure 14:
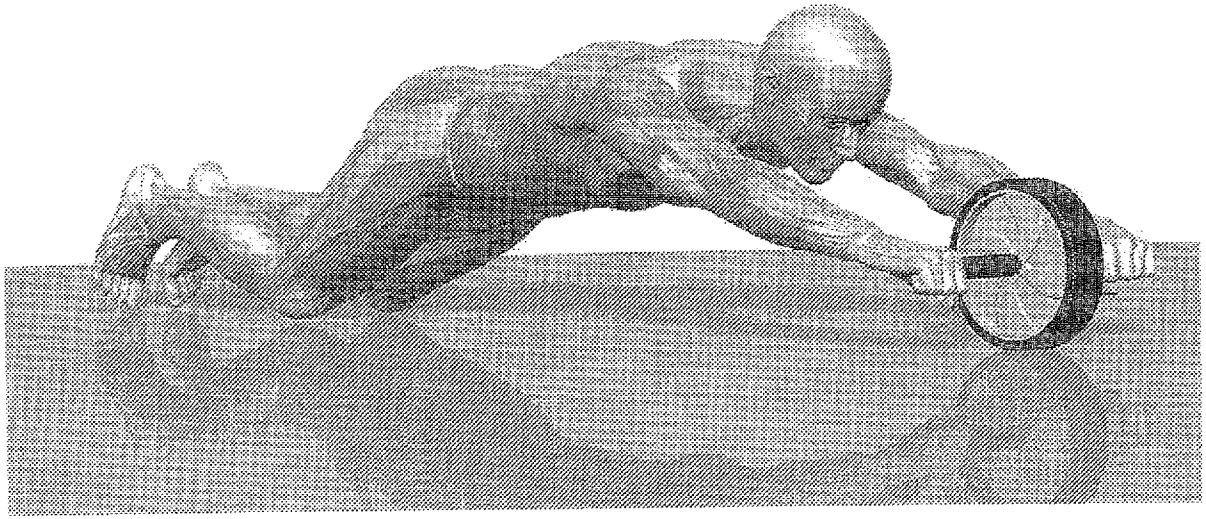
FIG. 14 shows the Ab Wheel, an existing abdominal exercise device.

Risers may be separate, attachable modules, or may be integrated into the machine itself and deployable as desired. For example, an integrated riser may be implemented as an fold-out panel that is attached to the underside of the machine using a hinge, as illustrated in FIG. 13A. When deployed, the riser 1501 swings out on hinge 1502 and locks into position, protruding from the underside of the machine, and causing framework 1503, supporting belt 1506 looped around front axle 1505 and back axle 1504, to become inclined. When not deployed, the riser 1501 is flush with the underside of the machine. Embodiments may include two integrated risers, one at the front end of the machine and the other at the back, allowing the user to create an upward or a downward incline. Similarly, an integrated riser may be deployed under the back end of the machine, creating a downward incline, as shown in FIG. 13B.

Risers may also be adjustable, providing steeper or shallower inclines as desired. For example, fold-out riser 1501 may be deployed at various angles, each associated with a locking mechanism allowing the riser to be fixed in place at a particular angle. Alternatively, some embodiments may be provided with multiple riser attachments, each one providing an incline of a different slope.

Some embodiments may use a grooved runner system that works without axles or sprockets. In such embodiments, the side edges of full-length belts or hand- or foot-sized "treadpads" consisting of left and right belt segments would be inserted into two parallel grooves running in either an oval-shaped path (e.g., the path of the belt in FIG. 2) in the case of full-length belts, or in a planar path representing the top running along the top surface of the machine, in the case of treadpads. These belts or treadpads could then be moved in both the forward and the backward direction along the grooves, which in some embodiments could be lined with rollers to facilitate movement of the belts or treadpads. The foregoing embodiments may include a resistance-control mechanism for controlling the force needed to move the belts or treadpads forward or backward. For example, they may employ a friction-based control mechanism similar to the one described above with reference to FIG. 4.

It will be appreciated that the scope of the present invention is not limited to the above-described embodiments, but rather is defined by the appended claims; and that these claims will encompass modifications of and improvements to what has been described.

What is claimed is:

1. An exercise system comprising:

a rigid framework;

a first belt attached to at least two axles, including at least one first axle positioned at a front of the rigid framework and at least one second axle positioned at a rear of the rigid framework, the first belt configured to roll relative to the framework in both clockwise and counter-clockwise directions;

a second belt attached to at least two axles, including at least one third axle positioned at the front of the rigid framework and at least one fourth axle positioned at the rear of the rigid framework, the second belt configured to roll relative to the framework in both clockwise and counter-clockwise directions, wherein the first and second axles are independently rotatable of the third and fourth axles; and a non-motorized resistance-control mechanism for controlling an amount of force required to roll the first and second belts in one or more of the clockwise and counter-clockwise directions, wherein the non-motorized resistance-control mechanism is operable to control an amount of force required to roll the first and second belts in the counter-clockwise direction, while allowing the first and second belts to roll freely in the clockwise direction.

2. The system of claim 1, wherein the first and second belts form continuous loops.

3. The system of claim 1, wherein the first belt and the second belt run along paths that are substantially parallel.

4. The system of claim 1, wherein the first belt and the second belt are constructed using a combination of rubber and plastic.

5. The system of claim 1, wherein the system is designed to interlock with systems above and beneath it, forming a vertical stack of similar systems.

6. The system of claim 1, wherein the resistance-control mechanism includes a resistance-control knob, and wherein the force required to roll the first and second belts is controlled by turning the resistance-control knob in the clockwise and counter-clockwise directions.

7. The system of claim 1, wherein the first and second belts each roll along a pair of parallel grooves.

8. The system of claim 1, wherein the first belt is rotatable at a different rate of rotation than a rotation of the second belt.

9. The system of claim 1, wherein the resistance-control mechanism further comprises a single resistance-control knob, and wherein the force required to roll both the first and second belts is controlled by rotating the single resistance-control knob.

10. The exercise system of claim 1, wherein each of the first and second belts remains movable when the non-motorized resistance-control mechanism controls the variable amount of force required to roll the first and second belts in one of the counter-clockwise direction and clockwise direction.

11. The exercise system of claim 1, wherein the variable amount of force required to roll the first and second belts in one of the counter-clockwise direction and clockwise direction is user-selected.

12. The exercise system of claim 1, wherein the non-motorized resistance-control mechanism further comprises at least one of a torsion spring and an elastic, wherein the variable amount of force required to roll the first and second belts in one of the counter-clockwise direction and clockwise direction is controlled by turning or stretching the at least one of the torsion spring and the elastic, and wherein allowing the first and second belts to roll freely in the other of counter-clockwise direction and the clockwise direction further comprises turning or retracting of the at least one of the torsion spring and the elastic.

13. An exercise system comprising:

a rigid framework;

at least one belt positioned on axles connected to the rigid framework, wherein the at least one belt is configured to roll relative to the framework in both clockwise and counter-clockwise directions; and a non-motorized single resistance-control mechanism positioned on the rigid framework, wherein the non-motorized single resistance-control mechanism controls an amount of force required to roll the at least one belt in one or more of the clockwise and counter-clockwise directions, wherein the non-motorized resistance-control mechanism is operable to control a user-selected amount of force required to roll the at least one belt in the counter-clockwise direction, while allowing the at least one belt to roll freely in the clockwise direction.

14. The system of claim 13, wherein the resistance-control mechanism includes a resistance-control knob, and wherein the force required to roll the at least one belt is controlled by turning the resistance-control knob in the clockwise and counter-clockwise directions.

15. The system of claim 14, wherein the resistance-control mechanism further comprises a top-half annular friction element and a bottom-half annular frictional element positioned around at least one resistance axle, wherein the at least one resistance axle is connected to at least a portion of the axles connected to the rigid framework.

16. The system of claim 15, wherein the resistance-control knob controls a force of contact between the top-half annular friction element and the at least one resistance axle, wherein rotation of the resistance-control knob compresses the resistance axle between the top-half annular friction element and the bottom-half annular frictional element.

17. The system of claim 13, wherein the at least one belt forms a continuous loop.

18. The system of claim 13, wherein the system is designed to interlock with systems above and beneath it, forming a vertical stack of similar systems.

19. The system of claim 13, wherein the at least one belt rolls along a pair of parallel grooves.

20. The system of claim 13, wherein the at least one belt rolls around front and rear axles.

21. The system of claim 13, wherein the exercise system is configured to be used for abdominal exercises.

22. The exercise system of claim 13, wherein the at least one belt remains movable when the non-motorized resistance-control mechanism controls the variable amount of force required to roll the at least one belt in one of the counter-clockwise direction and clockwise direction.

23. The exercise system of claim 13, wherein the variable amount of force required to roll the at least one belt in one of the counter-clockwise direction and clockwise direction is user-selected.

24. The exercise system of claim 13, wherein the non-motorized resistance-control mechanism further comprises at least one of a torsion spring and an elastic wherein the variable amount of force required to roll the at least one belt in one of the counter-clockwise direction and clockwise direction is controlled by turning or stretching the at least one of the torsion spring and the elastic, and wherein allowing the at least one belt to roll freely in the other of counter-clockwise direction and the clockwise direction further comprises turning or retracting of the at least one of the torsion spring and the elastic.

25. An exercise system comprising:

a rigid framework;

a first belt attached to at least two axles, including at least one first axle positioned at a front of the rigid framework and at least one second axle positioned at a rear of the rigid framework, the first belt configured to roll relative to the framework in both clockwise and counter-clockwise directions;

a second belt attached to at least two axles, including at least one third axle positioned at the front of the rigid framework and at least one fourth axle positioned at the rear of the rigid framework, the second belt configured to roll relative to the framework in both clockwise and counter-clockwise directions, wherein the first and second axles are independently rotatable of the third and fourth axles; and a resistance-control mechanism for controlling an amount of force required to roll the first and second belts in one or more of the clockwise and counter-clockwise directions, wherein the resistance-control mechanism includes a resistance-control knob, and wherein the force required to roll the first and second belts is controlled by turning the resistance-control knob in the clockwise and counter-clockwise directions, wherein the resistance-control mechanism further comprises a top-half annular friction element and a bottom-half annular frictional element positioned around at least one resistance axle, wherein the at least one resistance axle is connected to at least one of the first axle, the second axle, the third axle, and the fourth axle.

26. The system of claim 25, wherein the resistance-control knob controls a force of contact between the top-half annular friction element and the at least one resistance axle, wherein rotation of the resistance-control knob compresses the resistance axle between the top-half annular friction element and the bottom-half annular frictional element.

* * * * *